US006362710B2

(12) United States Patent
Oberndorfer

(10) Patent No.: US 6,362,710 B2
(45) Date of Patent: Mar. 26, 2002

(54) CONTACT UNIT FOR ELECTROMAGNETIC RELAYS

(75) Inventor: Johannes Oberndorfer, Miesbach (DE)

(73) Assignee: Matsushita Electric Works (Europe) AG, Holzkirchen (DE)

( * ) Notice: Subject to any disclaimer, the term of this patent is extended or adjusted under 35 U.S.C. 154(b) by 0 days.

(21) Appl. No.: 09/933,678

(22) Filed: Aug. 22, 2001

Related U.S. Application Data

(63) Continuation of application No. 09/461,386, filed on Dec. 15, 1999, now Pat. No. 6,300,854.

(30) Foreign Application Priority Data

Dec. 18, 1998 (DE) ..... 198 58 755

(51) Int. Cl.[7] ..... H01H 1/00; H01H 1/12

(52) U.S. Cl. ..... 335/196; 335/83; 335/200; 200/238; 200/243; 200/275

(58) Field of Search ..... 335/83, 196, 200; 200/243–146, 275, 283, 238–242

(56) References Cited

U.S. PATENT DOCUMENTS 2,665,352 A 1/1954 Bellamy et al.
2,853,578 A 9/1958 Rommell et al.
5,151,675 A 9/1992 Biehl et al. ..... 335/78

FOREIGN PATENT DOCUMENTS

| | | |
|---|---|---|
| DE | 757 518 | 5/1943 |
| DE | 1 175 807 | 8/1959 |
| DE | 32 24 468 | 5/1988 |
| DE | 32 24 013 | 11/1990 |
| DE | 94 04 775 | 7/1994 |
| EP | 0 081 164 | 6/1983 |
| EP | 0 443 075 | 8/1991 |

*Primary Examiner*—Ramon M. Barrera
(74) *Attorney, Agent, or Firm*—Connolly Bove Lodge & Hutz LLP

(57) ABSTRACT

For increasing the reliability of contact closure in safety relays, a contact spring (10) is provided with two contact pieces (15, 16) which are disposed at the free end of the contact spring (10), spaced transversely of the longitudinal axis thereof and cooperate with contact pieces (17, 18) disposed on a common fixed contact. The contact spring (10) has a zone (19) in which it is not only flexible but also sufficiently torsional about its longitudinal axis in order to ensure the closure of both contact couples. Disposing the free end of the contact spring (10) carrying the contact pieces (15, 16) at an angle with respect to the fixed contact (12) achieves smooth and low-bounce contact closure and at the same time provides the function of a pre-contact and a main contact.

14 Claims, 3 Drawing Sheets

CONTACT UNIT FOR ELECTROMAGNETIC RELAYS

CROSS-REFERENCE TO RELATED APPLICATION

The present application is a continuation of U.S. patent application Ser. No. 09/461,386, filed Dec. 15, 1999, now U.S. Pat. No. 6,300,854.

BACKGROUND OF THE INVENTION

For increasing the contact safety of electromagnetic relays, it is known, from German Patent No. 3,224,013, to provide the contact spring with a longitudinal slot to form two flexible ends and to equip each end with a contact piece which cooperates with a corresponding counter contact piece on a common fixed contact. The probability of both contact couples to fail due to contamination by minute glass fibers, moulding burs, or the like is substantially smaller than with single contacts.

These "twin" contact springs, which are similarly known from German Published Application No. 1,175,807, German Utility Model No. 9,404,775, and German Patent No. 972, 072, however, suffer from the difficulty that the spring arms formed by the longitudinal slot are more prone to breakage than the undivided spring. In such a case, while the relay per se is still operative, the broken spring arm may cause unpredictable short-circuits. A further problem of known twin contact springs resides in the fact that the individual spring arms are much softer than the undivided spring so that, when one contact becomes welded, the corresponding spring arm is not stiff enough to retain the actuator in the closed contact position. These properties prevent the use of known twin contact springs in safety relays.

German Patent No. 3,224,468 discloses a contact arrangement in which the contact spring carries two contact pieces each cooperating with a separate fixed contact. In addition to the fact that the total contact resistance of such bridge contacts is twice that of an individual contact couple, the known arrangement increases the safety in contact opening rather than in contact closure.

Further known are so-called "crown" contacts in which at least one of two cooperating contact rivets has a raised peripheral portion which, if the two rivets are somewhat offset with respect to each other, form two contact locations. In addition to the fact that these contact locations have very small areas, the raised periphery is relatively quickly worn in use so that the intended double contact feature is rapidly lost.

SUMMARY OF THE INVENTION

It is the object of the invention to provide a contact unit which increases the reliability of contact closure in safety relays, i.e. relays with forcibly guided contacts.

To meet this object, a contact unit in accordance with the invention includes a fixed contact providing two contact locations and a contact spring having a longitudinal axis, a fixed end and a free end, and providing two contact locations which are disposed at an undivided portion of the free end, spaced in a direction transverse of the longitudinal axis and cooperating with the contact locations of the fixed contact, a zone of the contact spring between the fixed end and the contact locations providing increased torsional flexibility about the longitudinal axis.

The fact that the contact spring has at least one zone which exhibits increased torsional flexibility about its longitudinal axis ensures closure of the contact couples, which are constituted by the contact locations of the contact spring and the counter contact locations of the fixed contact, even when the free end of the contact spring is not parallel to the fixed contact.

In contrast to the twin contact spring referred to above, the contact spring of the contact unit according to the invention is undivided throughout its length, so that breakage is less likely to occur and, if it occurs, will cause the relay to fail completely by interruption.

Each of the two contact couples may be formed by at least two separate contact pieces provided on the contact spring and the fixed contact. Alternatively, the contact locations of the contact spring and/or those of the fixed contact may be formed at one common contact piece.

In a preferred embodiment, the zone of increased torsional flexibility may be formed by reducing the width and/or the thickness of the contact spring.

To achieve forcible guidance of the contact spring by the actuator, specifically during opening, an area of the contact spring extending from the location of engagement with the actuator to the contact locations may be stiffer than any other area of the contact spring. Increased stiffness may be achieved by increased thickness or by a deformed portion, preferably by a bead extending along the longitudinal axis throughout the length of the contact spring.

In order to use the torsional behavior of the contact spring effectively, it is of advantage for an actuator to have a convex portion for engagement with the contact spring, preferably a pair of convex portions engaging opposite sides of the spring.

In another preferred embodiment, the straight line connecting the two contact locations of the contact spring intersects at an acute angle the straight line connecting the contact locations of the fixed contact. An intentional inclination is thus provided between the contact spring and the fixed contact to form a first closing and last opening pre-contact and a last closing and first opening main contact. This arrangement has the advantage of softer contact closure with reduced bouncing.

The contact locations of the pre-contact may be made of a less noble contact material, preferably AgSnO, than those of the main contact, which are preferably made of an AuAg alloy. Additionally or alternatively, the contact locations of the pre-contact may be dimensioned larger than those of the main contact. The pre-contact is thereby provided with properties suitable for a load contact, while the main contact has the qualities of a signal contact.

DETAILED DESCRIPTION OF PREFERRED EMBODIMENTS

Figure 1:
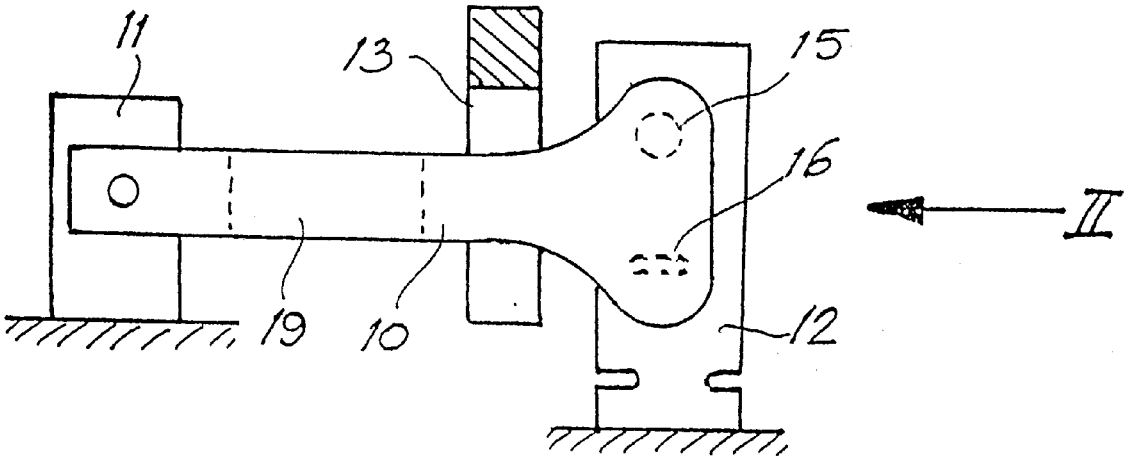
FIG. 1 is a schematic side view of a contact unit according to the invention.
Figure 2:
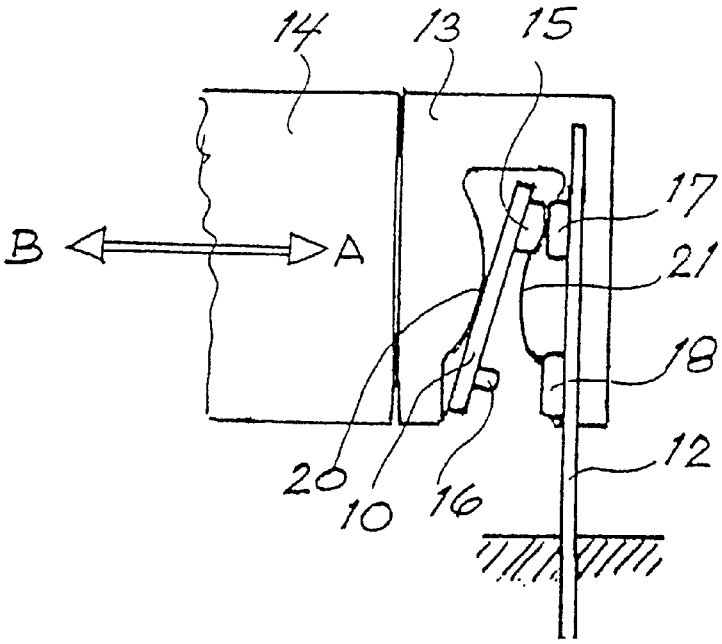
FIG. 2 is an end view taken in the direction of the arrow II in FIG. 1.

The contact unit shown in FIGS. 1 and 2 essentially consists of a contact spring 10, which has one of its ends mounted, such as by riveting, to a carrier 11, a fixed contact 12 opposite the free end of the contact spring 10, and an actuator 13 which engages the contact spring 10 and, in the present embodiment, is coupled to a relay armature 14 as indicated in FIG. 2.

The free end of the contact spring 10 opposing the fixed contact 12 is wider than the main part of the spring and carries two contact pieces 15, 16, arranged next to each other (below each other according to the drawing) in a direction transverse of the longitudinal extension of the contact spring 10. Similarly, the fixed contact 12 is provided with two contact pieces 17, 18 which are disposed opposite to, and cooperate with, the respective contact pieces 15, 16 of the contact spring 10.

As shown in FIG. 2, the free end of the contact spring 10 extends at an angle with respect to the fixed contact 12 so that the straight line interconnecting the contact pieces 15, 16 of the contact spring 10 intersects at an acute angle the straight line interconnecting the contact pieces 17, 18 of the fixed contact 12. This inclined attitude of the free end of the contact spring 10 is achieved by pre-torsioning the contact spring about its longitudinal axis in a torsion zone 19 located between the fixed and free ends of the spring.

The actuator 13 is so arranged and shaped that it engages the contact spring 10 close to the free end thereof and is capable of engaging either one of the opposite surfaces of the contact spring 10. Either zone of engagement 20, 21 of the actuator 13 is shaped convexly toward the respective surface of the contact spring 10.

When the armature 14, upon actuation of the relay, is moved in the direction of the arrow A, it moves the actuator 13 to the right as shown in FIG. 2. FIG. 2 shows the moment at which the upper contact piece 15 of the contact spring 10 just touches the contact piece 17 of the fixed contact 12. Upon further movement of the actuator 13 to the right, the front end of the contact spring 10 pivots about the contacting location between the contact pieces 15 and 17, which pivotal movement is enabled by a sufficient torsional capability of the flexure zone 19, until the lower contact pieces 16, 18 also contact each other. Subsequent further movement of the actuator 13 to the right into the end position of the armature 14 will then deflect the fixed contact 12 to increase the contact force between the two contact couples.

During the above-described pivotal motion of the free end of the contact spring 10 carrying the contact pieces 15, 16, the contact spring moves along the convex zone of engagement 20 of the actuator 13.

For opening the relay, the armature 14 is moved in the direction of the arrow B so that now the other zone of engagement 21 of the actuator 13 will engage the opposite surface of the contact spring 10 and cause the contact pieces 15, 16 of the contact spring to be lifted off the contact pieces 17, 18 of the fixed contact 12. This will first open the lower contact couple 16, 18, and subsequently the upper contact couple 15, 17.

In accordance with the function explained above, the upper contact couple 15, 17 forms a pre-contact, and the lower contact couple 16, 18 forms a main contact. Since the first closing and last opening pre-contact constitutes a load contact and will wear more rapidly, the contact piece 15, as shown in FIG. 1, is formed larger than the contact piece 16 belonging to the main or signal contact. Further, the contact pieces 15, 17 of the pre-contact are made of less noble material than the contact pieces 16, 18 of the main contact. As an example, the contact pieces 15, 17 may be of AgSnO, and the contact pieces 16, 18 of an AuAg alloy.

Instead of pre-torsioning the torsion zone 19, the inclined attitude of the free end of the contact spring 10 with respect to the fixed contact 12 shown in FIG. 2 may be achieved by inclining the fixed contact 12 or inclining the carrier 11 of the contact spring 10 which, in this case, is planar, in its rest position.

Figure 3:
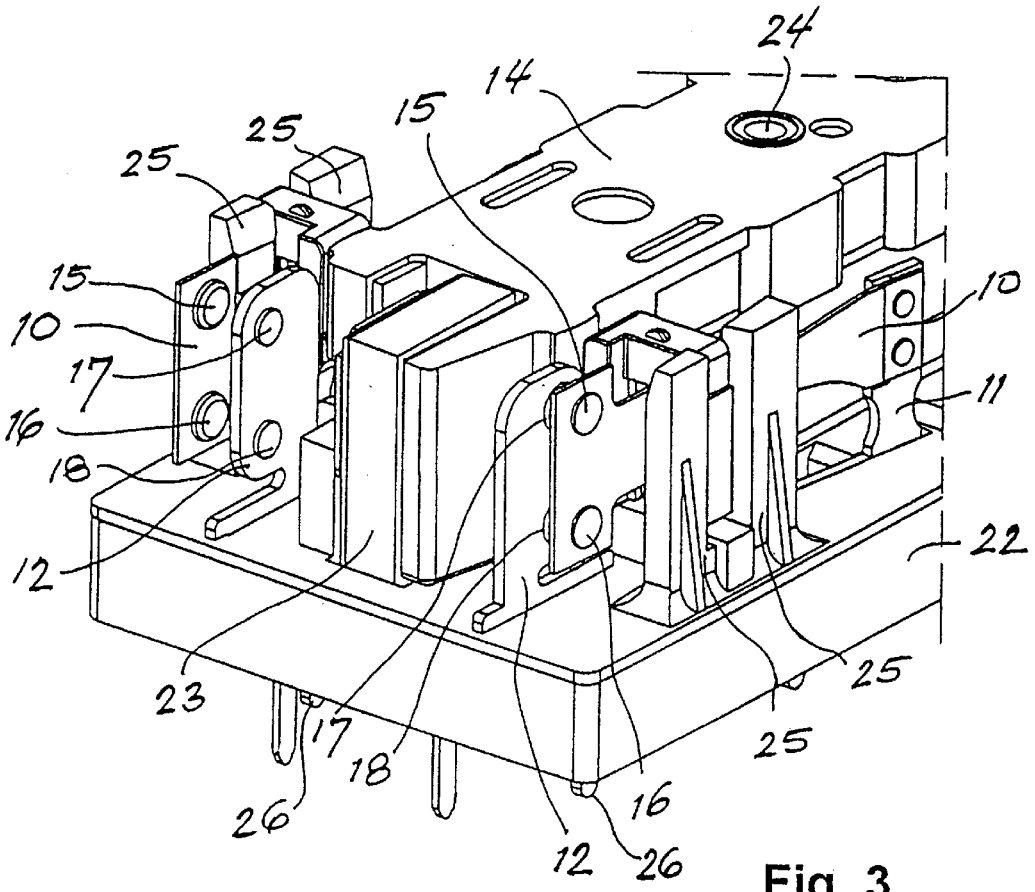
FIG. 3 is a perspective representation of part of an electromagnetic relay incorporating the contact unit in accordance with the invention.

The electromagnetic relay shown in part in the perspective view of FIG. 3 (wherein the housing cap has been omitted) includes a base 22 and a leg 23 of a yoke which extends through a coil (not shown). The yoke leg 23 projects from the base 22 and is disposed between the two arms of the relay armature 14 which, in the present embodiment, is generally H-shaped and supported on a bearing stud 23 provided on the base 22 for pivotal movement about a vertical central axis.

Figure 4:
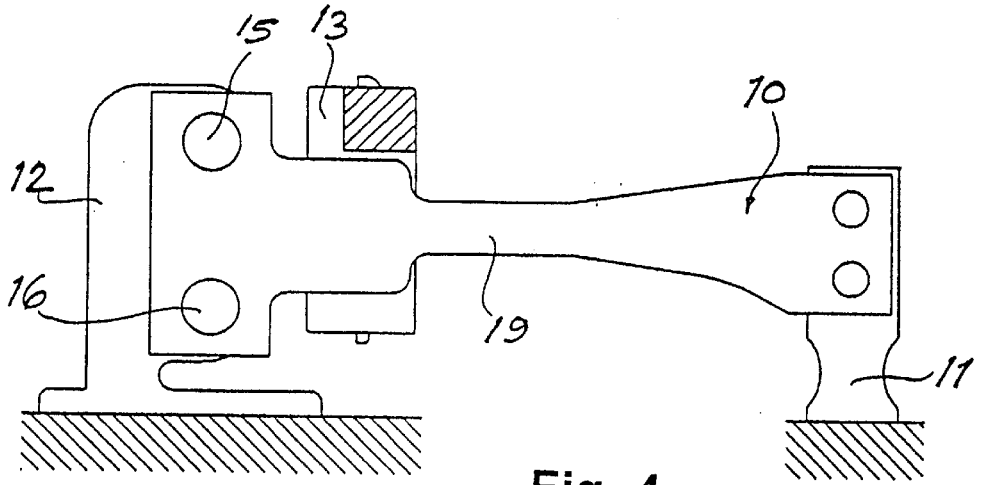
FIG. 4 is a view similar to FIG. 1 of the contact unit used in the relay of FIG. 3.
Figure 5:
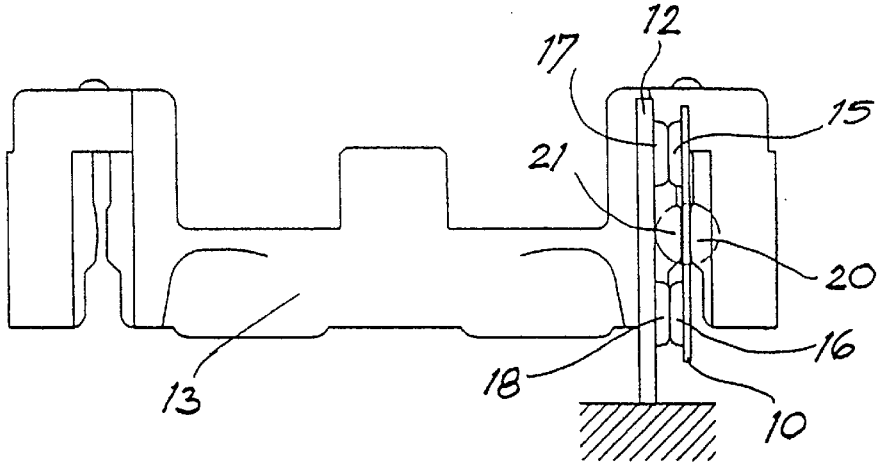
FIG. 5 is an end view showing the actuator of the embodiment of FIG. 3 with one contact spring.
Figure 6:
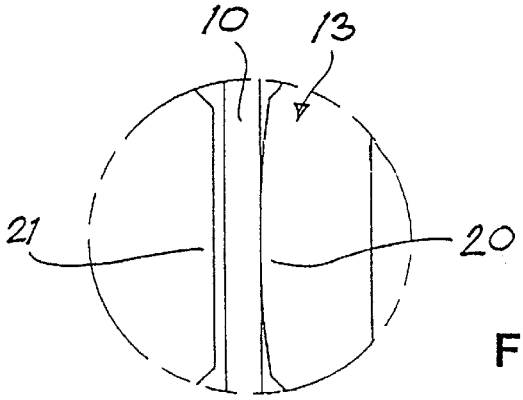
FIG. 6 is an enlarged representation of part of FIG. 5.

The actuator 13 coupled to the relay armature 14 is slidably guided in its plane by guide columns 25 formed on the base 22 and, as shown in more detail in FIGS. 4 to 6, engages the contact spring 10. The contact pieces 15, 16 of the spring cooperate with the contact pieces 17, 18 provided on the fixed contact 12. In FIG. 3, the relay is shown as fitted with two contact springs 10. Terminal pins 26 of the fixed contacts 12 project downward from the base 22.

In the contact spring 10 shown in more detail in FIG. 4, the torsion zone 19 has been realized by reducing the width of the spring. Alternatively or additionally, the zone 19 of the spring 10 may be reduced in thickness or treated in other ways to increase its torsional flexibility.

The zone 19 is situated between the fixed end of the contact spring 10, which is riveted to the contact carrier 11, and the zone of engagement of the actuator 13. The contact spring 10 has its full width within this zone of engagement as well as at both of its ends, the width being again increased at the free end so as to provide sufficient spacing between the contact pieces 15 and 16. The actuator 13 engages the contact spring 10 in a stiffened zone.

As appears from FIG. 5 and the enlarged detail view of FIG. 6, the contact spring 10 extends between the two engagement zones 20, 21 of the actuator 13, of which the zone 20 is convex or crowned, to permit the contact spring 10 to rotate about its longitudinal central axis when pressed, and to ensure contact closure at both contact couples 15, 17 and 16, 18. At the opposite engagement zone 21, which engages the contact spring 10 during opening, a convex or crowned shape is not required. Where the contact spring 10 is biased into the closed position, the region 21 of the actuator 13 engaging the spring should also be crowned.

Figure 7:
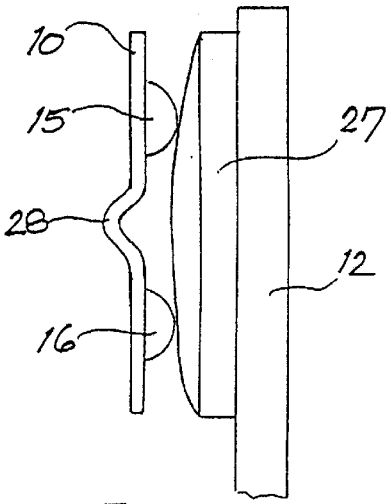
FIG. 7 shows a modification of the contact arrangement in a representation corresponding to FIG. 2.

In the embodiment shown in FIG. 7, the two contact locations disposed on the fixed contact 12 are formed as one common contact piece 27, the contact surface of which is so dimensioned that it can cooperate with the two separate contact pieces 15 and 16 of the contact spring 10. To enable proper contact closure even when the contact spring 10 is torsioned or the fixed contact 12 extends at an angle, the contact surface of the common contact piece 27 has a crowned shape.

Figure 8:
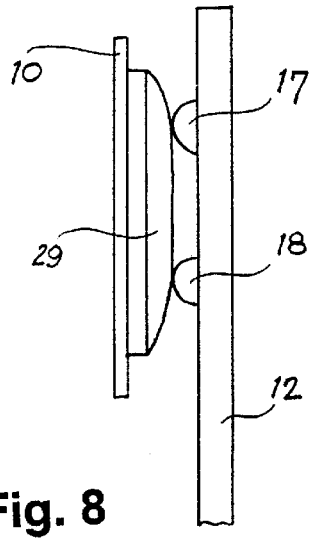
FIG. 8 shows a further modification of the contact arrangement.

Instead of the embodiment shown in FIG. 7, a large common contact piece may be provided on the contact spring 10 and cooperate with two separate contact pieces on the fixed contact 12 (see FIG. 8).

In a further conceivable alternative, a single continuous contact piece may be provided on both the contact spring 10 and the fixed contact 12, with at least one of such continuous contact pieces being provided with two projections to produce two spaced contact locations.

As further shown in FIG. 7, the contact spring 10 is provided with a bead 28 extending in the direction of its longitudinal central axis to enhance the stiffness of the contact spring 10 along its longitudinal direction within the region between the contact springs 15, 16 and the engagement zone of the actuator 13.

Instead of the bead 28, the stiffness of the contact spring 10 may be achieved by increasing its thickness within the region between the contact pieces 15, 16 and the zone of engagement with the actuator 13.

If the bead 28 shown in FIG. 7 is used for stiffening, it may extend throughout the length of the contact spring 10 all the way to its end mounted on the contact carrier 10. Such a bead 28, which extends in the direction of the longitudinal central axis and thus in the neutral zone of the contact spring 10, while resulting in reduced bendability also within the zone 19, impairs the torsional flexibility in this zone to a small degree only.

What is claimed is:

1. A contact unit for electromagnetic relays, the contact unit comprising a fixed contact providing two contact locations, an actuator, and a contact spring having a longitudinal axis, a fixed end and a free end, and providing two contact locations disposed at an undivided portion of said free end, spaced in a direction transverse of said longitudinal axis and cooperating with the contact locations of said fixed contact, a zone of said contact spring between said fixed end and said contact locations providing increased torsional flexibility about said longitudinal axis, wherein an area of said contact spring extending from the location of engagement with said actuator to said contact locations has a greater stiffness than any other area of said contact spring.

2. The contact unit of claim 1, wherein said area of greater stiffness has an increased thickness.

3. The contact unit of claim 1, wherein said area of greater stiffness includes a deformed portion.

4. The contact unit of claim 3, wherein said deformed portion includes a bead extending along said longitudinal axis.

5. The contact unit of claim 4, wherein said bead extends throughout the length of said contact spring.

6. The contact unit of claim 1, wherein the contact locations of said contact spring are formed at one common contact piece.

7. The contact unit of claim 1, wherein the contact locations of said fixed contact are formed at one common contact piece.

8. The contact unit of claim 1, wherein at least one of the width and thickness of said contact spring is smaller in said zone of increased torsional flexibility than in any other area of the contact spring.

9. The contact unit of claim 1, wherein said actuator has a convex portion for engagement with said contact spring.

10. The contact unit of claim 9, wherein said actuator has convex portions for engagement with opposite sides of said contact spring.

11. The contact unit of claim 1, wherein a straight line interconnecting the two contact locations of said contact spring intersects at an acute angle with a straight line interconnecting the contact locations of said fixed contact.

12. The contact unit of claim 11, wherein the contact locations of said contact spring and said fixed contact constitute a first and a second contact couple, said first contact couple closing before and opening after the second contact couple, and wherein the contact locations of said first contact couple are made of a less noble contact material than those of said second contact couple.

13. The contact unit of claim 12, wherein the contact locations of said first contact couple are made of AgSnO and those of said second contact couple are made of an AuAg alloy.

14. The contact unit of claim 12, wherein the contact locations of said first contact couple are dimensioned larger than those of said second contact couple.

* * * * *